United States Patent [19]

Tamano

[11] 4,171,814

[45] Oct. 23, 1979

[54] METHOD OF PLAYING A BOARD GAME

[76] Inventor: Toshio Tamano, 317 W. 105th St., New York, N.Y. 10025

[21] Appl. No.: 902,975

[22] Filed: May 4, 1978

[51] Int. Cl.[2] ..... A63F 3/02

[52] U.S. Cl. ..... 273/243; 273/263; 273/271

[58] Field of Search ..... 273/243, 255, 262, 263, 273/271

[56] References Cited

U.S. PATENT DOCUMENTS

| | | | |
|---|---|---|---|
| 1,216,355 | 2/1917 | Persyn | 273/263 |
| 2,368,896 | 2/1945 | Stewart | 273/271 |
| 3,977,677 | 9/1976 | Magiera | 273/255 |

FOREIGN PATENT DOCUMENTS

| | | | |
|---|---|---|---|
| 453165 | 4/1967 | Switzerland | 273/262 |
| 432197 | of 1935 | United Kingdom | 273/263 |

*Primary Examiner*—Richard C. Pinkham
*Assistant Examiner*—R. C. Moy
*Attorney, Agent, or Firm*—Hubbell, Cohen, Stiefel & Gross

[57] ABSTRACT

A board game comprises two playing surfaces, each including a grid defining a plurality of spaces, the number of spaces in each grid being the same, first and second sets of playing pieces including means for distinguishing one set of pieces from the other, each piece being dimensioned for placement in a single space, and chance means manipulatable by the players for determining the number of movements allotted to the players, the object being for each player to place his selected set of pieces on his opponent's grid to surround one or more of the opponent's pieces placed on that grid at the commencement of play. A method of playing the game is also disclosed.

7 Claims, 7 Drawing Figures

METHOD OF PLAYING A BOARD GAME

BACKGROUND OF THE INVENTION

1. Field of the Invention

This invention pertains to board games and more particularly to board games of the type wherein a plurality of playing pieces are manipulated on playing surfaces comprising grids.

2. Statement of the Prior Art

Games played on boards comprising grids defining a plurality of spaces are, of course, well known. Checkers, chess, Othello and Go are well known examples. In some grid board games, the object is to "capture" the opponent's pieces, this being accomplished, for example, when one player "out-flanks" his opponent's pieces as by placing one or more of his pieces on either side thereof. Examples of grid board "capture" type games include Seejah and I-Ching, the latter having been developed by applicant herein. All of these games, however, are played on a single grid board on which both players simultaneously place and move their pieces.

One game known to applicant, commonly referred to as Battleship, is played on two substantially identical grid boards. Each player selects one grid, which he maintains hidden from his opponent's view during play. The rows and columns of the grids are identified by letters and numbers. Each player places his "ships", which may occupy one or more spaces, on his grid. Thereafter, the players alternate calling out squares on each other's grids, identifying the square by row and column, the object being to locate a square upon which the opponent has placed a ship. Play is continued until one player has located and "destroyed" all of the spaces upon which his opponent has placed his ships. It will be apparent that this game is based primarily on chance. Moreover, there is no manipulation of the pieces or "ships" once they are placed on the grids.

SUMMARY OF THE INVENTION

According to the invention, I have developed a novel game which combines the elements of chance and skill, is easy to learn and fun to play, and may be enjoyed by children and adults alike. The novel apparatus for playing the game comprises two grids, each defining an equal number of spaces, two sets of playing pieces including means for distinguishing one set from the other, and chance means manipulatable by the players for determining the number of movements allotted to each player on his or her turn.

According to the preferred method of play, each player selects one set of pieces and one grid and places two pieces from his set on his grid on a predetermined space. The pieces placed by the players on their selected grids at the commencement of play I prefer to call Daimyo pieces. The remaining pieces in each player's set I prefer to call Samurai pieces. After the Daimyo pieces have been placed on the grids, one of the players is selected, as by manipulation of the chance means, as the first player to move. That player then manipulates the chance means, which may comprise, for example, three cubes each having a single dot on three surfaces thereof, to determine the number of moves allotted to that player on that turn. For example, each upwardly facing dot could represent one move. Each move can be used by either moving a Daimyo piece to a contiguous space or by placing a Samurai piece on an unoccupied space on the opponent's grid. When the first player has used all his moves, the second player then manipulates the chance means to determine the number of moves allotted to him. Like the first player, he can use each move to either move a Daimyo piece to a contiguous space or to place a Samurai piece on an unoccupied space on his opponent's grid.

The object of each player's movements is to surround his opponent's Daimyo pieces before his own Daimyo pieces are surrounded. It will thus be apparent that a player cannot concentrate exclusively on surrounding his opponent's Daimyo pieces since, if he does, his own Daimyo pieces will quickly be surrounded. On the other hand, he cannot concentrate exclusively on moving his own Daimyo pieces so as to escape being surrounded since, if he does, he will never be able to surround his opponent's Daimyo pieces and win the game. It will therefore be clear that both luck, based on the roll of the cubes, and skill are required to win the game.

According to the preferred method of play, the winning player must surround both his opponent's Daimyo pieces in a single territory. According to the most preferred method of play, the winning player must also force both his opponent's Daimyo pieces back onto a common space. When one player has placed his Samurai pieces so as to surround his opponent's Daimyo pieces in a single territory with only one possible path of movement between the Daimyo pieces, for each move allotted to the player controlling the Samurai pieces he is permitted to move one of his opponent's Daimyo pieces one space closer to the other Daimyo piece and place a Samurai piece in the vacated space. This phase of the game, which I prefer to call Tsuiseki, is continued until the player controlling the Samurai pieces has forced both his opponent's Daimyo pieces onto a common space. Since Daimyo pieces cannot move into a space occupied by a Samurai piece nor can they jump over Samurai pieces, the surrounded Daimyo pieces can no longer move and the game is over. Although the game need not be played with scoring, I prefer to allot 100 points to the winner plus an additional 10 points for each unused Samurai piece.

Further features and advantages of the method and apparatus for playing the game of the invention will become more fully apparent from the following detailed description and annexed drawings of the preferred embodiments thereof.

DETAILED DESCRIPTION OF THE PREFERRED EMBODIMENT

Figure 1:
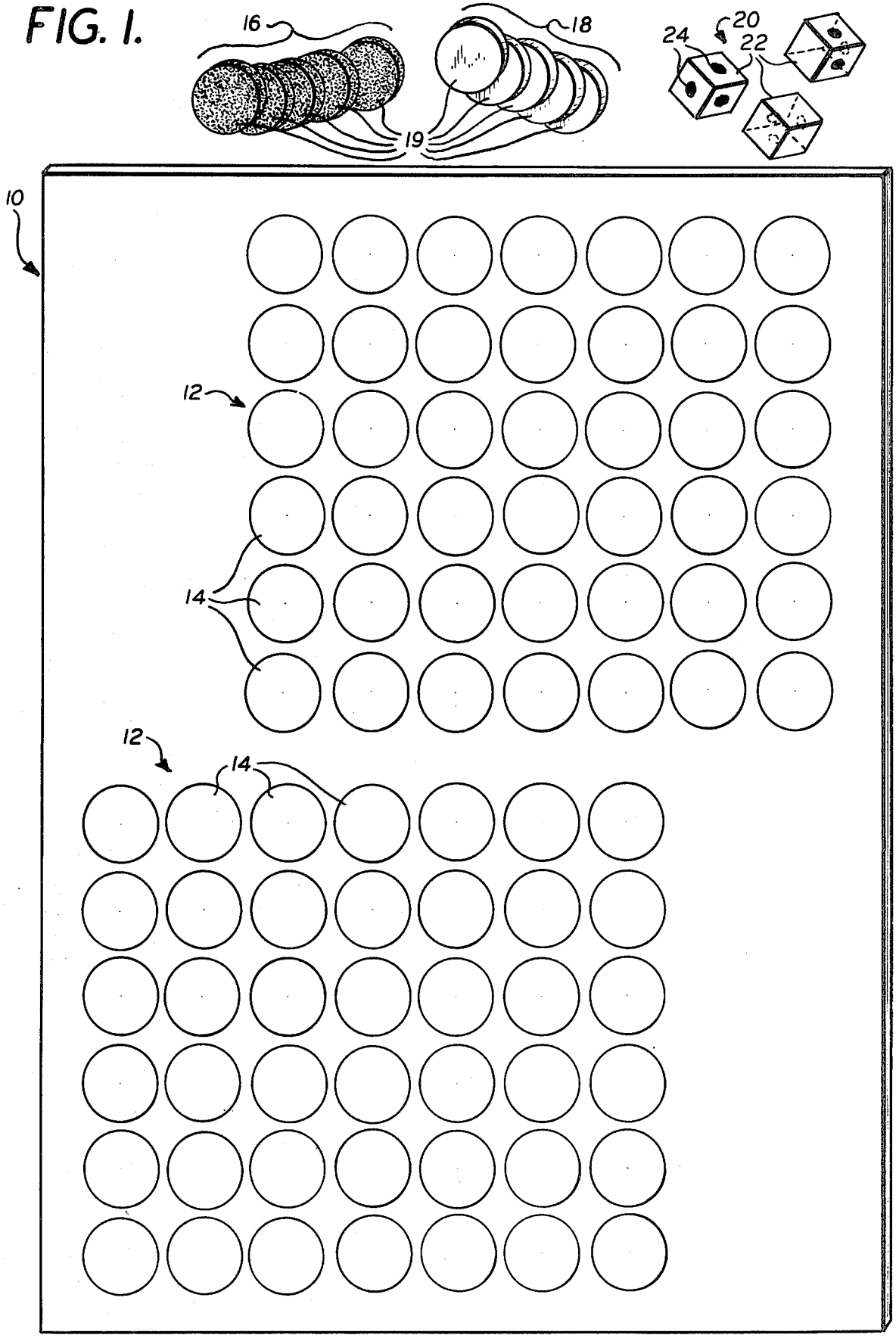
FIG. 1 is a perspective view showing the preferred apparatus for playing the game according to the present invention.

Referring initially to FIG. 1, the preferred apparatus for playing the game according to the invention is shown. This apparatus includes a board 10 comprising two separate but identical grids 12, each defining a plurality of spaces 14, two distinguishable sets 16 and 18 of playing pieces 19, and chance means 20 manipulatable by the players for determining the movement and placement of the pieces 16 and 18 on the grids 12.

As presently preferred and shown, each grid 12 comprises a rectangular array of circular spaces 14, shown here to be made up of six rows and seven columns. While such an array is preferred, it is not necessary, and other rectangular arrays comprising different numbers of rows and columns could be used. In fact, although rectangular arrays are preferred, this too is not necessary. Thus, circular, elliptical or other grid forms could also be used. Also, while circular spaces are shown based on personal preference, it should be clear that differently shaped spaces, such as square spaces, may be used. Furthermore, although it is preferred that both grids 12 are laid out on a single board or surface 10, this too is not mandatory and two surfaces, one for each grid, could be employed.

When the grids 12 of FIG. 1 are used to play the game of the invention, each set 16 and 18 of pieces will preferably comprise twenty three pieces (only five from each set are shown in FIG. 1). However, and as will be more fully apparent hereinafter, the exact number of pieces in each set is not critical and more or less than twenty three pieces could also be used. The pieces preferably comprise plastic discs, different colors being used to distinguish the pieces in one set from those in the other. Of course, it will be apparent that the pieces may be made from any one of numerous materials, may take on a variety of different shapes and that means other than different colors may be employed for distinguishing the sets 16 and 18 from each other.

As illustrated, chance means 20 preferably comprises three cubes 22 each having a single marking or dot 24 on three faces thereof. It is desirable that the cubes 22 be similar in size to conventional dice so that they may be easily manipulated or "rolled" by the players. However, as this description progresses, it will become apparent that chance means 20 other than the cubes 22 may be employed for determining the movement and placement of the pieces 19 on the grids 12.

Figure 2:
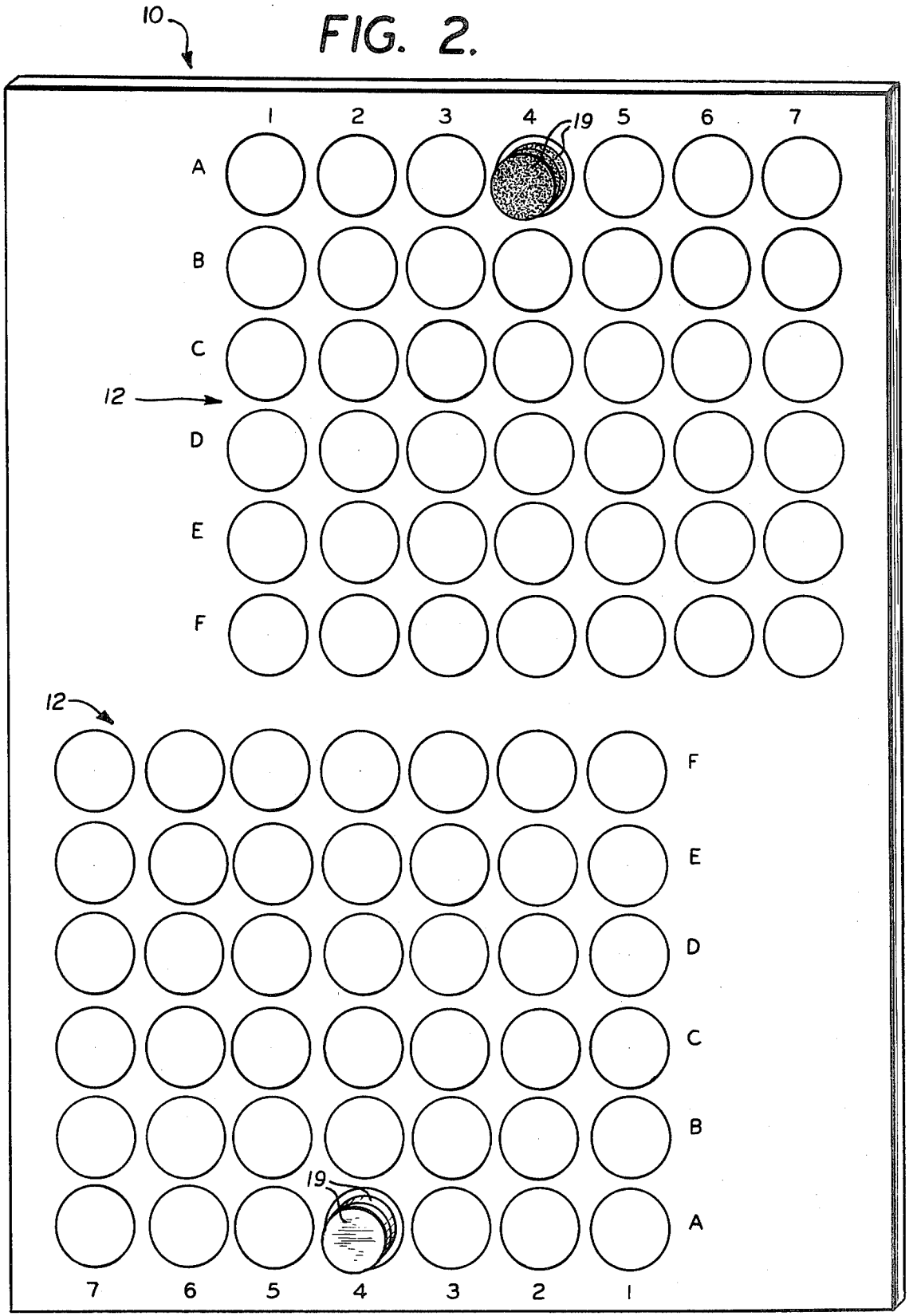
FIG. 2 is a view similar to FIG. 1 showing the position of the apparatus at the commencement of the preferred method of play, the rows and columns of the grids being lettered and numbered, respectively, solely for purposes of illustration.

According to the preferred method of play, to commence play each of the players selects one of the grids 12 and one set of pieces 16 or 18. Each player then takes two of his pieces 19, and places them, one on top of the other, in a predetermined space 14. Referring to FIG. 2, where solely for the purpose of simplifying this description the rows and columns of the grids 12 have been identified by letters and numbers, respectively, each player preferably places his two pieces 19 on the space 14 in row A, column 4. While this is preferred, it will be apparent hereinafter that these two pieces may be placed on any other space 14 and that both pieces need not initially be placed on the same space. It will also be appreciated hereinafter that one or more than two pieces 19 may be placed on the grids 12 at the commencement of play. It is desirable, however, that both players place the same number of pieces on their selected grid. The only critical limitation is that the players place their starting pieces on different grids. The two pieces 19 placed by each player on his selected grid at the commencement of play I prefer to call "Daimyo" pieces.

After the players have selected grids and placed their Daimyo pieces thereon, one of the players is selected as the first to move. This may be accomplished, for example, by having each player roll the cubes 22, the player whose roll yields the greater number of dots 24 facing upwards being selected as the first to move. However, this is not necessary and other means, such as the flip of a coin, may be used to determine who will move first.

Figure 3:
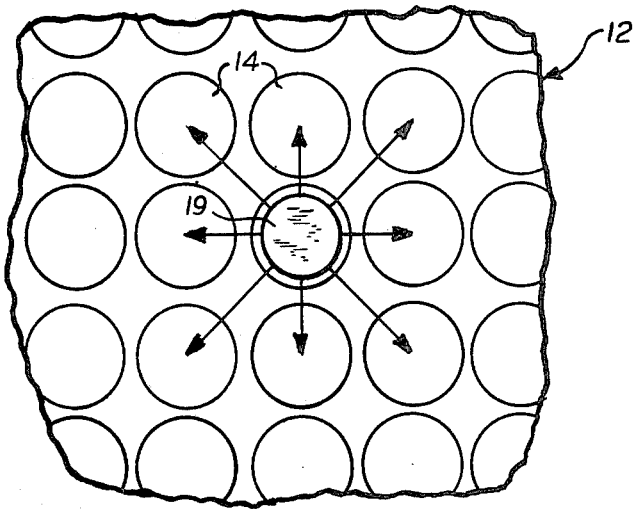
FIG. 3 is a fragmentary plan view of one of the grids shown in FIG. 1 showing the permitted movements of a Daimyo piece.

The first player to move rolls the cubes 22 and then counts the total number of dots facing upwards. Each dot represents one move. Thus, it will be apparent that upon any roll of the cubes 22, the player rolling may be entitled to 0, 1, 2 or 3 moves. Each move may be used in one of two ways. Thus, a move can be used to move a Daimyo piece from the space it is on to any contiguous space. This is illustrated in FIG. 3, wherein all the possibilities for a single move of a Daimyo piece 19 are illustrated by the arrows. Although, as shown in FIG. 3, it is preferred that Daimyo pieces may be moved to diagonally contiguous spaces, this is not mandatory and movement may be restricted to horizontally and vertically contiguous spaces. According to the preferred method of play, the players are not entitled to move the Daimyo pieces together. In other words, once play is commenced, the players cannot move both Daimyo pieces from their starting space to another common space nor, once separate, can the Daimyo pieces ever be moved back to a common space except, as will be explained hereinafter, at the end of the game. While this rule is not mandatory, it is preferred as it has been found to add to the skill and excitement of the game.

Alternatively, a player may use a move to place one of that players twenty-one remaining pieces, which I prefer to call Samurai pieces, on any unoccupied space 14 of his opponent's grid 12. Samurai pieces, once placed on the opponent's grid 12, may not again be moved. Assuming the roll of the cubes 22 indicates that the player is entitled to more than one move, he may divide these moves up between moving his Daimyo pieces and placing Samurai pieces on his opponent's grid.

In placing Samurai pieces on the opponent's grid, the object is to surround the opponent's Daimyo pieces. Thus, referring again to FIG. 2, if the player who selected the set 16 of pieces 19 could place Samurai pieces in the spaces 14 in row A, columns 3 and 5 and row B, columns 3, 4 and 5, he would completely surround his opponent's Daimyo pieces. In other words, the opponent would be incapable of moving his Daimyo pieces on his next turn since a player cannot move a Daimyo piece to a space occupied by his opponent's Samurai piece, nor can a Daimyo piece jump a Samurai piece, nor can a Daimyo piece be moved off the grid. Once a player has surrounded his opponent's Daimyo pieces in this manner, the game ends, the player whose Daimyo pieces are surrounded being the loser, the other player being the winner. It will therefore be apparent that the players cannot concentrate exclusively on surrounding their opponent's Daimyo pieces, or they will quickly find their own Daimyo pieces surrounded. Nor can they concentrate exclusively on moving their own Daimyo pieces, since they will never then be able to surround their opponent's Daimyo pieces. Accordingly, in order for a player to win the game he will have to exercise skill in splitting his moves between movement of his own Daimyo pieces and placement of his Samurai pieces on his opponent's grid.

After the first player has moved, the other player then rolls the cubes 22 to determine the total number of moves to which he is entitled. Like the first player, the second player may either move his own Daimyo pieces, place Samurai pieces on his opponent's grids, or both. After the second player has completed his turn, the first player again rolls the cubes 22 to determine how many moves he has on that turn, and so forth, play alternating between the players until one player has surrounded his opponent's Daimyo pieces in the manner described hereinabove.

Figure 4:
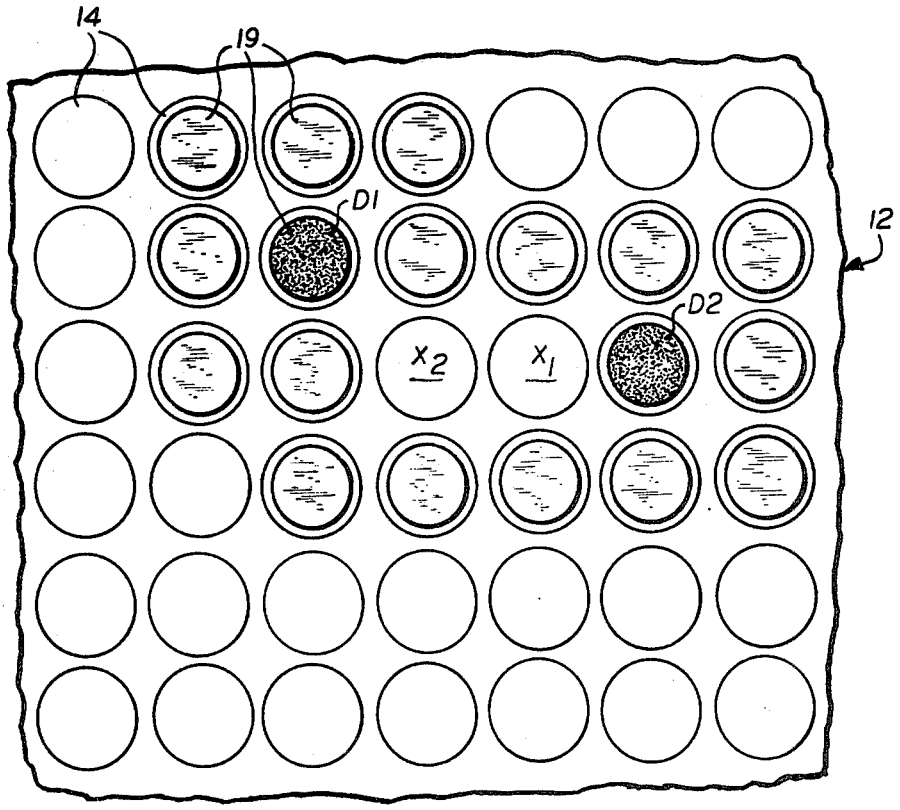
FIG. 4 is a plan view of one of the grids in FIG. 1 showing a hypothetical positioning of Daimyo and Samurai pieces during play.

According to the preferred method of playing the game, the players are not permitted to position their Samurai pieces so as to isolate the opponent's Daimyo pieces in separate territories. In other words, there must always be a path of movement between a player's two Daimyo pieces. Referring to FIG. 4, the player controlling the unshaded pieces 19 could not place a Samurai piece in either of the spaces designated X, as these spaces represent the sole remaining path between his opponent's Daimyo pieces. Consequently, placement of a Samurai piece in one of these spaces would result in isolation of the opponent's Daimyo pieces in separate territories. Under these circumstances, the player controlling placement of the unshaded Samurai pieces could, for each move to which he is entitled, move one of his opponent's Daimyo pieces one space closer to the other Daimyo piece and then place one of his Samurai pieces in the vacated space. I prefer to refer to this phase of the game, i.e. wherein a player forces his opponent's Daimyo pieces closer to each other, as Tsuiseki.

For example, referring again to FIG. 4, if the cubes 22 indicate that the player controlling placement of the unshaded Samurai pieces is entitled to two moves, he could move his opponent's Daimyo piece D1 two spaces to the space $X_1$ and then place Samurai pieces in the space $X_2$ and the space initially occupied by the piece D1. Alternatively, he could move his opponent's Daimyo piece D2 two spaces to the space $X_2$ and then place his Samurai pieces in the space $X_1$ and the space initially occupied by the piece D2. He could even move Daimyo piece D1 to space $X_1$ and Daimyo piece D2 to space $X_2$ and then place his Samurai pieces in the spaces vacated by the Daimyo pieces. However, it should be apparent that the net result of all these moves is the same, namely, that his opponent's Daimyo pieces will be next to each other and surrounded on all sides by his Samurai pieces. Of course, the player controlling movement of the unshaded Samurai pieces need not use both or even one of his moves in the manner described above, but could, instead, move his own Daimyo pieces as this may be necessary to effect escape from his opponent's Samurai pieces.

Figure 5:
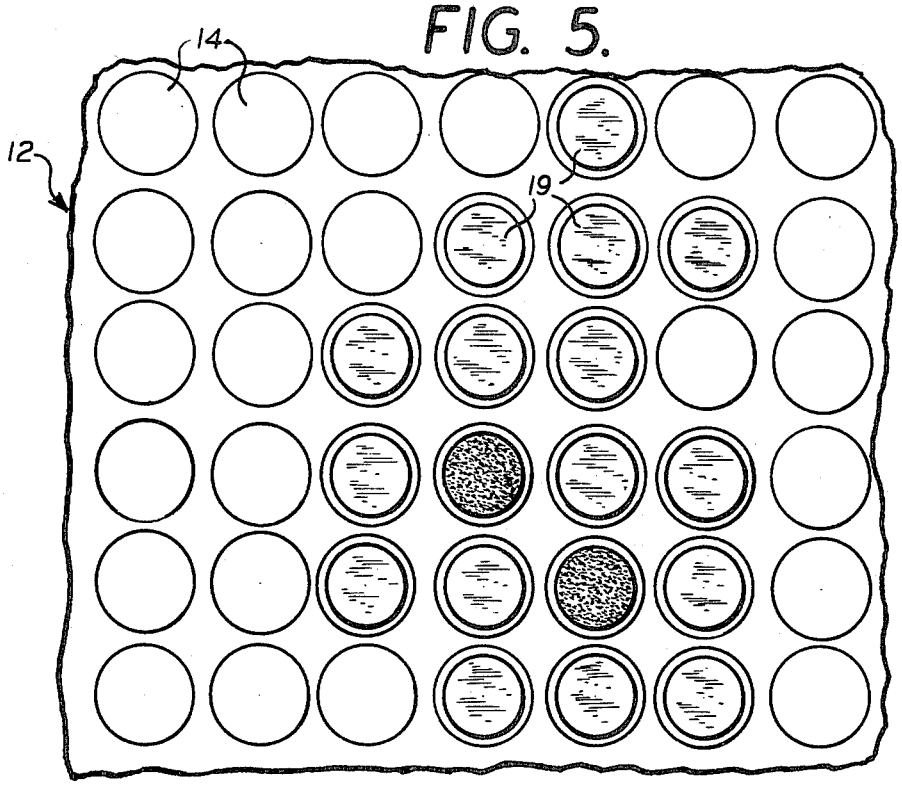
FIG. 5 is a view similar to FIG. 4 showing another hypothetical positioning of Daimyo and Samurai pieces during play.
Figure 6:
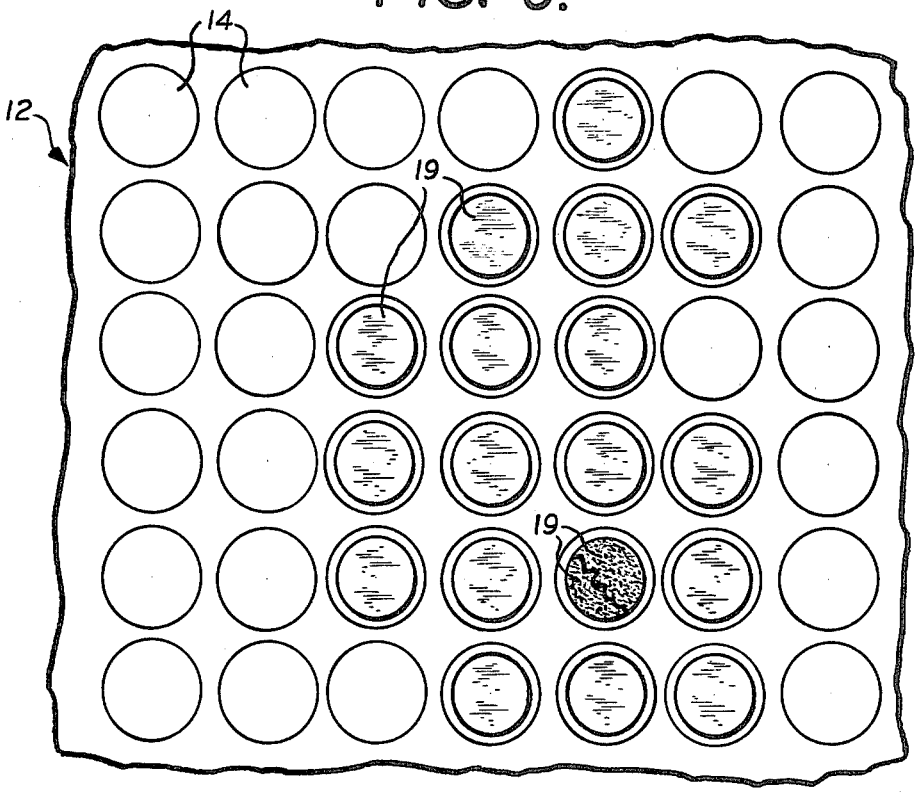
FIG. 6 is another view similar to FIG. 4 showing a hypothetical positioning of Samurai and Daimyo pieces at the end of play.

As noted above, the object of the game is to completely surround an opponent's Daimyo pieces. Thus, while play could be considered ended when a player's Daimyo pieces are next to each other and surrounded on all sides by his opponent's Daimyo pieces, preferably play will be continued until one player has forced both his opponent's Daimyo pieces back onto a single space. Referring to FIG. 5, assuming the player controlling the unshaded Samurai pieces is entitled to at least one move, he can use that one move to force one of his opponent's Daimyo pieces onto the space occupied by the other Daimyo piece and then place one of his Samurai pieces in the vacated space thereby ending play (FIG. 6). As already noted, according to the preferred method of play this is the only time, apart from the beginning of the game, when a player's Daimyo pieces may occupy the same space. As already noted, play can be considered ended at other times. Thus, if the game is played without Tsuiseki, that is, where a player is not entitled to move his opponent's Daimyo pieces toward each other when they are completely surrounded in one territory, play can be considered ended when both an opponent's Daimyo pieces are surrounded in a single territory even though they do not occupy contiguous spaces. As a further alternative, the game need not be played with a requirement that a player's Daimyo pieces be surrounded in a single territory, in which case play could be terminated when a player's Daimyo pieces are surrounded in separate territories. However, and as already noted, it is preferred that the game be played with Tsuiseki and that play be continued until both Daimyo pieces of one player are forced onto a common space 14.

In the event one player uses up all of his Samurai pieces without being able to force his opponent's Daimyo pieces onto a common space, but the opponent still has unused Samurai pieces, preferably play will be continued until the opponent has used up all of his Samurai pieces or has been able to force the other player's Daimyo pieces onto a common space, which ever occurs first. In a preferred method of playing the game, after one player has used up all of his Samurai pieces, the cubes 22 are no longer used, each player being entitled only to a single move on his turn which may comprise either moving one Daimyo piece one space or placing one Samurai piece on the board.

Figure 7:
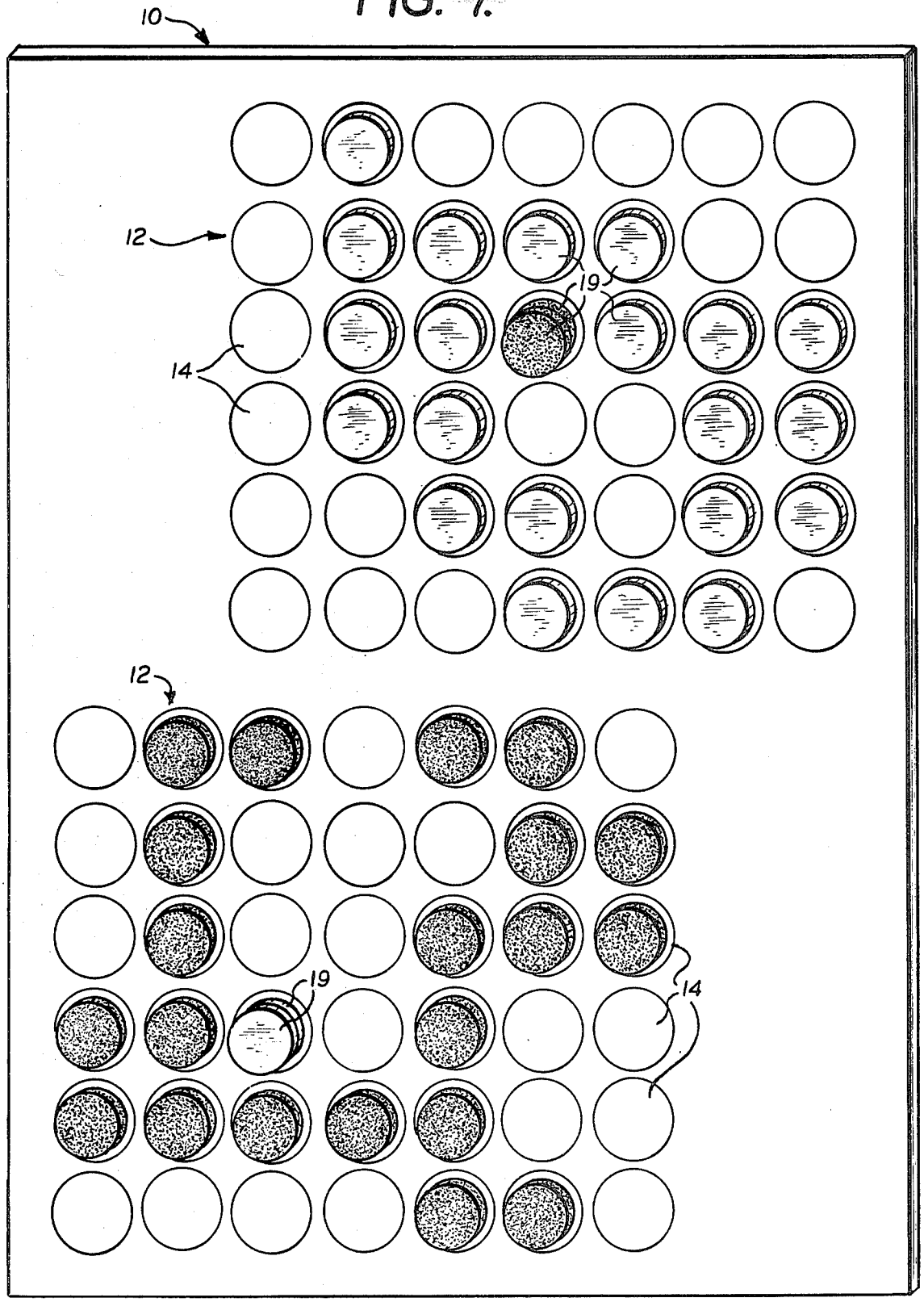
FIG. 7 is a view similar to FIG. 1 showing another hypothetical positioning of Samurai and Daimyo pieces at the end of play.

While the game may be played without scoring, according to the preferred method of play, scoring is as follows: 100 points to the player who forces both his opponent's Daimyo pieces onto a common space and 10 points to that player for each unused Samurai piece. For example, referring again to FIG. 6, the player controlling placement of the unshaded Samurai pieces would receive 100 points for forcing his opponent's Daimyo pieces onto a common space and an additional 50 points since he has only used sixteen of his twenty-one Samurai pieces. Preferably, in the event both players use up all of their Samurai pieces without being able to force the opponent's Daimyo pieces onto a common space, then each player takes one of his Daimyo pieces and moves it into the space occupied by his other Daimyo piece. Each player then proceeds to count the number of unoccupied spaces surrounded by his opponent's Samurai pieces. Each space counts as 10 points. The player who has restricted his opponent's Daimyo pieces to the least number of spaces will be the winner. Referring, for example, to FIG. 7, after each player has placed his Daimyo pieces on a common space, it may be seen that the player controlling the unshaded set of pieces has left only three unoccupied spaces in the surrounded territory whereas the player controlling the shaded set of pieces has left seven unoccupied spaces. The player who has left the least number of spaces, in this case the player controlling the unshaded pieces, is the winner. According to the preferred method of scoring, the winner is entitled to 10 points for each additional space left unoccupied by his opponent. Thus, in the example shown in FIG. 7, the winner would be entitled to 40 points since he has left only three surrounded spaces unoccupied while his opponent has left seven surrounded spaces unoccupied.

While I have herein shown and described the preferred apparatus and method for playing the game of the present invention and have suggested certain variations thereof, other changes and modifications within the scope of the present invention are also contemplated. Accordingly, the above description should be construed as illustrative, and not in the limiting sense, the scope of the invention being defined by the following claims.

What is claimed is:

1. A method for playing a game for two players which comprises the steps of:

(A) providing first and second sets of playing pieces including means for distinguishing one set of pieces from the other set;

(B) providing first and second grids each defining a plurality of spaces, the number of spaces in each grid being the same;

(C) providing chance means manipulatable by said players for determining the number of movements allotted to said players for placing and moving said pieces on said grids in said spaces;

(D) each of said players selecting a different one of said first and second sets of pieces;

(E) each of said players selecting a different one of said first and second grids and placing at least one of his selected set of pieces in a space thereon;

(F) selecting one of said two players as the one to commence play;

(G) manipulating said chance means to determine the number of movements allotted to said one player;

(H) said one player performing a movement by (i) moving his said at least one piece from the space occupied by said piece on his selected grid to another space on his selected grid contiguous with said occupied space or (ii) placing one of the remaining pieces from his selected set of pieces in an unoccupied space on the grid selected by the other player, the total number of movements performed by said one player equalling the number of movements allotted to him as determined by said chance means;

(I) manipulating said chance means to determine the number of movements allotted to said other player;

(J) said other player performing a movement by (i) moving his said at least one piece from the space occupied by said piece on his selected grid to another space on his selected grid contiguous with said occupied space or (ii) placing one of the remaining pieces from his selected set of pieces in an unoccupied space on the grid selected by said one player, the total number of movements performed by said other player equalling the total number of movements allotted to him as determined by said chance means; and (K) repeating steps (G) through (J) until (i) said at least one piece of at least either said one player or said other player is surrounded by his opponent's said remaining pieces or (ii) at least either said one player or said other player has placed all of his said remaining pieces from his selected set of pieces on the grid selected by his opponent.

2. The method of playing a game according to claim 1, wherein step (E) comprises each player placing two of his selected set of pieces on his selected grid.

3. The method of playing a game according to claim 2, wherein said two pieces are placed in a common space.

4. The method of playing a game according to claim 2, wherein step (K) (i) is repeated until said two pieces of at least either said one player or said other player are surrounded in a single territory.

5. The method of playing a game according to claim 3, wherein said step (K) (i) comprises repeating steps (G) through (J) until said two pieces are surrounded in a single territory with only one path of movement between said two pieces remaining, the player who has surrounded said two pieces then being permitted to move one of said two pieces one space along said path and placing one of his said remaining pieces in the space vacated by said moved piece for each movement allotted to him by said chance means, until one of said two pieces is forced to move into the space occupied by the other of said two pieces.

6. The method of playing a game according to claim 1, wherein said step (B) comprises providing rectangular grids and wherein said movement performing step (H) (i) comprises moving said at least one piece to either a horizontally, vertically, or diagonally contiguous space.

7. The method of playing a game according to claim 1, wherein said step (K) (ii) comprises repeating steps (G) through (J) until both players have placed all their said remaining pieces on their opponent's grids.

* * * * *